United States Patent [19]

Steck

[11] 4,435,367

[45] Mar. 6, 1984

[54] BARREN SOLVENT WASH BY OXIDIZED RAFFINATE ACID IN THE PROCESS OF URANIUM EXTRACTION FROM PHOSPHORIC ACID

[75] Inventor: Edward J. Steck, Lakeland, Fla.

[73] Assignee: Wyoming Mineral Corporation, Lakewood, Colo.

[21] Appl. No.: 285,666

[22] Filed: Jul. 21, 1981

[51] Int. Cl.[3] ..... C01G 43/00

[52] U.S. Cl. ..... 423/10; 423/8

[58] Field of Search ..... 423/8–10

[56] References Cited

U.S. PATENT DOCUMENTS

| | | | |
|---|---|---|---|
| 3,711,591 | 1/1973 | Hurst et al. | 423/10 |
| 3,966,873 | 6/1976 | Elikan et al. | 423/10 |
| 4,002,716 | 1/1977 | Sundar | 423/10 |
| 4,011,296 | 3/1977 | Ruiz et al. | 423/10 |
| 4,190,633 | 2/1980 | Smith et al. | 423/10 |
| 4,292,278 | 9/1981 | Elikan et al. | 423/10 |
| 4,374,806 | 2/1983 | Abodishish et al. | 423/10 |

*Primary Examiner*—Edward A. Miller

*Attorney, Agent, or Firm*—D. P. Cillo

[57] ABSTRACT

In a uranium recovery process, barren, organic solvent, which contains entrained, reduced iron containing phosphoric acid, exiting the stripper is contacted with oxidized raffinate acid, before extraction, in an amount effective to remove about 70% to 98% of the entrained acid.

9 Claims, 1 Drawing Figure

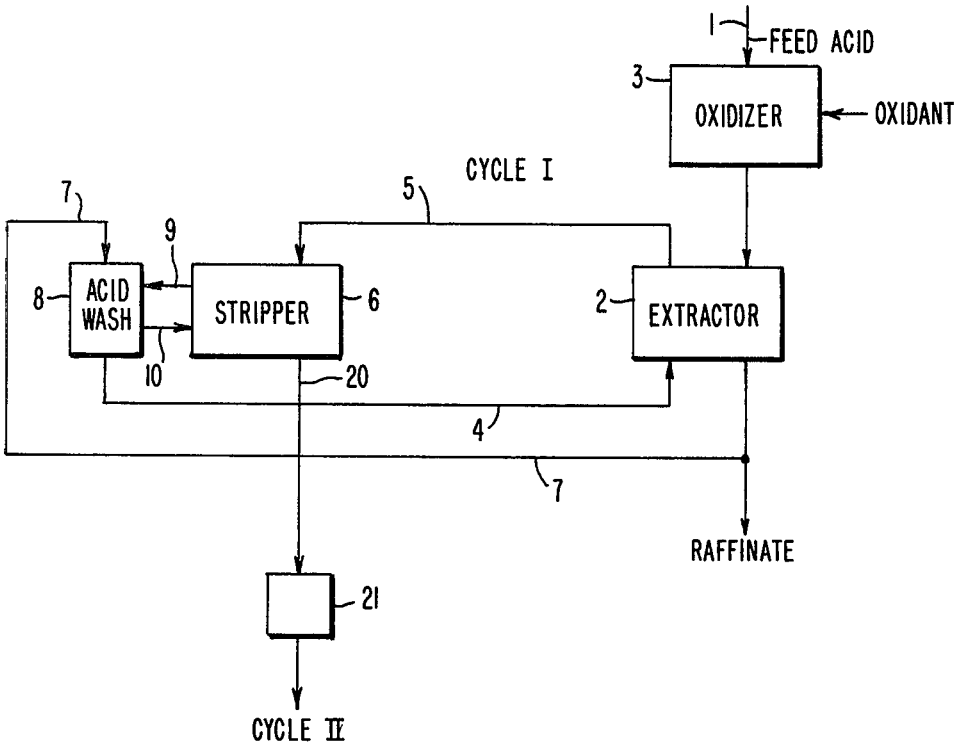
1
FEED ACID
3
OXIDIZER
OXIDANT
CYCLE I
5
7
9
8
ACID WASH
STRIPPER
6
2
EXTRACTOR
10
20
4
7
RAFFINATE
21
CYCLE II

BARREN SOLVENT WASH BY OXIDIZED RAFFINATE ACID IN THE PROCESS OF URANIUM EXTRACTION FROM PHOSPHORIC ACID

BACKGROUND OF THE INVENTION

Uranium can be recovered from commercial grade wet process phosphoric acid by an oxidative extraction-reductive stripping process. In this process, an oxidized phosphoric acid solution is contacted, generally in a multistage, counter-current extractor, with an organic extractant solvent composition having an affinity for oxidized uranium values. After extraction, two phases are formed, namely an oxidized, aqueous acid raffinate phase and an organic solvent phase rich in oxidized uranium values. Then, the organic solvent phase is reductively stripped of its uranium content, by a strip acid solution, generally in a multistage countercurrent reductive stripper. The stripped, barren organic solvent, containing reducing materials, is then generally passed to a decanter, to allow entrained strip acid to settle, and returned to the extraction system.

The uranium can be recovered from the strip acid by first again oxidizing the acid and then re-extracting the oxidized uranium in a second cycle extraction. The uranium can be recovered from the second cycle solvent using an ammonium carbonate strip solution and a precipitation stage. This process is well known in the art, and is taught for example by Hurst et al., in U.S. Pat. No. 3,711,591; Elikan et al., in U.S. Pat. No. 3,966,873 and Sundar, in U.S. Pat. No. 4,002,716.

Decanting the barren, organic solvent after the first cycle stripping, allows entrained strip acid to separate from the barren solvent to a certain extent, before the solvent is recycled to the extractor. However, humic acid gunk and other solids accumulate in the decanter. The barren, organic solvent also evidences a lowering of extraction efficiency when it is recycled to the extractor, because the entrained acid reduces the uranium in the extraction acid. Smith et al., in U.S. Pat. No. 4,190,633, recognized acid entrainment and solids accumulation problems in the uranium rich organic solvent phase; and attempted to solve them, before the stripping stage, by clarification, water wash, and caustic treatment with NaOH and $Na_2C0_3$, to produce regenerated organic solvent. This process, however, involves five separate steps, use of caustic chemicals, and would not solve extraction efficiency problems.

SUMMARY OF THE INVENTION

The above problems are solved and the above needs met by feeding part of the oxidized, aqueous acid raffinate stream exiting the extractor, into a mixer-settler which is near or attached to the last stage of the first cycle multi-stage reductive stripper. In the mixer-settler, oxidized, aqueous acid raffinate contacts barren organic solvent, which contains entrained phosphoric acid and reduced iron, exiting the stripper and before extraction. The oxidized aqueous acid raffinate is added in an amount effective to remove about 70% to 98% of the entrained, reduced iron containing phosphoric acid from the barren, reduced organic solvent. The total contact volume ratio of oxidized, aqueous acid raffinate:barren, organic solvent, which contains entrained, reduced iron containing strip acid is from about 2 to 5:10.

The acid phase is then fed into the last stage of the stripper, and the acid washed organic phase is pumped to the extractor. This process is effective to remove most of the entrained phosphoric acid from the organic, along with the $Fe^{+2}$ contained therein, and thus the acid washed organic phase has a lowered reducing effect. Use of the acid washed organic phase can significantly increase the uranium extraction coefficient upon recycle into the multi-stage extractor.

BRIEF DESCRIPTION OF THE DRAWING

For a better description of the invention, reference may be made to the preferred embodiments exemplary of the invention, shown in the accompanying drawing, which is a simplified flow diagram, illustrating the first cycle extraction-acid wash-stripping cycle of this invention.

DESCRIPTION OF THE PREFERRED EMBODIMENTS

In the first cycle of the uranium extraction process, phosphoric feed acid from line 1 enters extractor-settler 2, which may contain 1 to 6 stages. This feed from domestic phosphate is typically a 35° C. to 50° C. aqueous 5 M to 6 M solution of wet process phosphoric acid having a pH of about 0.1 about 2.5, and containing about 0.1 to about 0.5 g/l of uranium (as the oxidized uranyl ion, $UO_2^{+2}$), about 600 g/l of phosphate and about 1 to 15 g/l of iron. In the process shown, the phosphoric acid may be oxidized by any suitable means in oxidizer 3, to ensure that the uranium is in the +6 oxidation state, i.e., uranyl ion. In the extractor-settler 2, the feed acid is contacted by mixing with a water immiscible, organic extractant composition from line 4. The organic extractant solvent composition contains reagents which extract the uranyl ions into the organic solvent.

Typically, the solvent composition from line 4 is added in a 0.5 to 1 solvent to phosphoric feed acid ratio (by volume). The solvent composition from line 4 contains about 0.2 to 0.7 mole of di-alkyl phosphoric acid additive having from 4 to 10 carbon atoms in each chain, preferably di-2-ethylhexyl phosphoric acid (D2EHPA) per liter of solvent. The solvent also contains about 0.025 to about 0.25 mole of a synergistic additive agent well known in the art, for example, a trialkylphosphine oxide, where the alkyl chains are linear from $C_4$ to $C_{10}$, preferably tri-n-octylphosphine oxide (TOPO) per liter of solvent. These synergistic agents allow reduction of equipment size while increasing uranium extraction. The solvent is usually a hydrocarbon diluent such as kerosine. While the description herein is primarily directed to D2EHPA/TOPO mixtures, it is to be understood that other useful di-alkyl phosphoric acid/trialkylphosphine oxides can be used.

The organic solvent stream, rich in complexed, oxidized uranium, and containing some entrained phosphoric acid, passes through line 5 to reductive stripper 6, which may contain 1 to 4 stages, to strip uranium from the organic solvent. In the stripper, $Fe^{+2}$ ions are oxidized as the uranyl ion is reduced to the $U^{+4}$ ion. The organic solvent stream, as it exits the stripper through line 9, contains some entrained phosphoric acid, containing reduced iron, $Fe^{+2}$, from the stripper, which provide it with a certain amount of reducing effect. This reducing effect, if not compensated for, will eventually lower the extraction coefficient in the extractor 2 to which it is recycled. A portion of the oxidized, aqueous, wet process acid raffinate from extractor 2 passes through line 7 to the mixer-settler acid wash 8, in accordance with this invention.

In the mixer-settler acid wash 8, oxidized acid raffinate contacts barren organic solvent, containing from about 0.1 vol. % to about 2.0 vol. % of entrained phosphoric acid containing reduced $Fe^{+2}$, and a certain amount of humic acid gunk and other solids. During countercurrent flow, the oxidized acid raffinate removes the entrained, reduced iron containing phosphoric acid, so that organic exiting line into line 4, contains only about 0.03 vol. % entrained acid, and a corresponding much lower $Fe^{+2}$ content.

The oxidized aqueous acid raffinate is added in an amount effective to remove a substantial amount, about 70% to 98% of the entrained, reduced, iron containing, phosphoric acid from the barren, organic solvent. The total contact volume ratio of oxidized, aqueous acid raffinate:barren, organic solvent, which contains entrained, reduced iron containing phosphoric acid is from about 2 to 5:10. Under 2 vol. parts raffinate acid/10 vol. parts organic, minimal entrained phosphoric acid is removed with no improvement in the extraction coefficient. Over 5 vol. parts raffinate acid/10 vol. parts organic, causes the mixture to be aqueous continuous.

The acid phase is fed into the last stage of the stripper through line 10. It will be contacted with elemental iron so that is is effective to strip uranium from the organic entering through line 5. The $Fe^{+3}$ present in the acid phase 10 is reduced by the elemental iron, so that additional $Fe^{+2}$ is present to reduce the uranyl ion. By the term "total contact volume ratio" is meant, the total amount of acid to solvent in each phase in the washer-settler, i.e., while the volume ratio of feed from line 7:feed from line 9 may vary from 0.1 to 0.7:10, the oxidized acid in the acid wash 8 is usually recycled, or allowed to build up in the acid wash, not shown in the drawing, so that the phase ratio of total contacting acid:organic, in the acid wash, is from about 2 to 5:10.

Finally, the $U^{+4}$ ion in the product acid strip solution in line 20 is oxidized to the uranyl ion in oxidizer 21, to enable the uranium to be extracted again in Cycle II. The product from Cycle I contains phosphoric acid and typically has a pH of about 0.1 to 2.5. It contains about 25 g/l to 40 g/l of iron, and about 3 g/l to 15 g/l of uranium.

For a complete description of the Cycle II extraction and stripping process, reference may be made to U.S. Pat. Nos. 3,966,873 and 4,002,716, herein incorporated by reference.

EXAMPLE 1

In an operation similar to that shown in the drawing, but without an acid wash step, hot, commercial grade, wet-process, aqueous, phosphoric acid (30% $P_2O_5$; sp. gr. = 1.36), containing about 0.2 gram/liter of uranium and about 10 grams/liter of iron was clarified, oxidized, and fed into an extractor. In the extractor, uranium values were extracted into a water-immiscible, organic extractant solvent composition containing 0.5 mole of di-2-ethylhexyl phosphoric acid (D2EHPA) and 0.125 mole of tri-n-octylphosphine oxide per 1 liter of kerosine as diluent.

The organic extractant solvent, containing uranium values was passed from the extractor to a reductive stripper system at about 40° C., to allow stripping of uranium values from the solvent into a portion of the acid raffinate. The raffinate was from the first cycle extractor and had been reduced by elemental iron.

In the stripper, the reduced strip acid contacted the organic phase containing uranium values where part of the iron +2 in the strip acid was oxidized to iron +3 in the process of stripping the uranium values.

The barren, organic solvent was then recycled back to the extractor. After steady state operation, the extraction coefficient, i.e., wt. concentration of uranium exiting the extractor in the organic/wt. concentration of uranium exiting the extractor in the acid, fell from about 2.7 to 2.1. This loss in efficiency was due to entrained phosphoric acid containing reduced iron, $Fe^{+2}$, in the barren, organic solvent exiting the stripper, giving the extractant solvent a substantial reducing effect. It was found by centrifuging techniques, that the barren organic solvent contained about 0.4 vol. % of entrained acid.

In accordance with the invention, part of the oxidized raffinate acid was now first fed into a mixer-settler to acid wash the barren organic solvent, which contained entrained, reduced iron containing phosphoric acid, exiting the stripper. The acid stream was later passed through a reducing loop containing elemental iron in the stripper itself, so as to be an effective strip solution. For each 100 gpm of barren, organic solvent from the stripper, 4.5 gpm of oxidized raffinate acid fresh from the extractor, without being passed through an iron cone, was used in the mixer-settler acid wash shown in the Drawing. However, the oxidized acid was recycled within the acid wash to build a total volume ratio in each phase of 1 part acid to 3 parts organic. After steady state operation was reached, a centrifugal sample of organic exiting the acid wash showed only 0.03 vol. % entrained acid, a 92.5% reduction in entrained acid and corresponding $Fe^{+2}$. In addition, the extraction coefficient recovered from 2.1 to 2.5.

I claim:

1. In the method of recovering uranium from wet process phosphoric acid, where, in the first cycle of the process, wet process phosphoric acid feed solution is passed through an extraction means to provide a uranium rich organic solvent stream containing di-alkyl phosphoric acid and trialkylphosphine oxide extractants and an oxidized, aqueous raffinate acid stream, and wherein the uranium rich solvent stream is passed through a reductive stripper means, to provide a barren, organic solvent stream which contains entrained, reduced iron containing phosphoric acid, and a product acid stream which is oxidized and passed to the second cycle of the uranium recovery process; the improvement comprising, in the first cycle of the process, contacting the barren, organic solvent stream which contains entrained, reduced iron containing phosphoric acid exiting the stripper means, and before extraction, with an acid wash of oxidized raffinate acid, in an amount effective to remove about 70% to 98% of the entrained phosphoric acid.

2. In the method of recovering uranium from wet process phosphoric acid, where, in the first cycle of the process, wet process phosphoric acid feed solution is passed through an extraction means to provide a uranium rich organic solvent stream containing di-alkyl phosphoric acid and trialkylphosphine oxide extractants and an oxidized, aqueous raffinate acid stream, and wherein the uranium rich solvent stream is passed through a reductive stripper means, to provide a barren, organic solvent stream which contains entrained, reduced iron containing phosphoric acid, and a product acid stream which is oxidized and passed to the second cycle of the uranium recovery process; the improvement comprising, in the first cycle of the process, contacting the barren, organic solvent stream which contains entrained, reduced iron containing phosphoric acid exiting the stripper means, and before extraction, with an acid wash of oxidized raffinate acid, in a total contact volume ratio of oxidized, aqueous acid raffinate:barren, organic solvent which contains entrained, reduced iron containing phosphoric acid of about 2 to 5.10.

3. The method of claim 2, wherein the amount of reduced iron containing phosphoric acid entrained in the barren, organic solvent stream is from about 0.1 vol. % to about 2.0 vol. %, the acid wash removes about 70% to 98% of the entrained phosphoric acid, and the extraction coefficient in the extractor is improved.

4. The method of claim 2, where the entrained phosphoric acid contains iron in the $Fe^{+2}$ state.

5. The method of claim 3, wherein the solvent stream comprises di-alkyl phosphoric acid, tri-octyl-phosphine oxide and kerosine diluent.

6. The method of claim 2, wherein contact of the barren, organic solvent with the oxidized raffinate acid, causes the solvent to have a lower reducing effect.

7. The method of claim 5, wherein the acid washed organic solvent stream is passed to the extractor means.

8. The method of claim 5, wherein the product acid stream of the reductive stripper means is first oxidized. and then passed to a second cycle to recover uranium by re-extracting the uranium and then stripping the uranium using an ammonium carbonate strip solution.

9. The method of claim 1, wherein contact of the barren, organic solvent with the oxidized raffinate acid, causes the solvent to have a lower reducing effect and the extraction coefficient in the extractor is improved.

* * * * *